United States Patent [19]

Burghardt

[11] Patent Number: 4,546,679

[45] Date of Patent: Oct. 15, 1985

[54] RISER TEE WRENCH

[76] Inventor: Stanley M. Burghardt, 94-20 Plattwood Ave., Ozone Park, N.Y. 11417

[21] Appl. No.: 531,441

[22] Filed: Sep. 12, 1983

[51] Int. Cl.[4] ..... B25B 13/02

[52] U.S. Cl. ..... 81/119

[58] Field of Search ..... 81/119, 55

[56] References Cited

U.S. PATENT DOCUMENTS

| | | | |
|---|---|---|---|
| 1,408,444 | 3/1922 | Collins | 81/119 |
| 2,640,382 | 6/1953 | Grossman | 81/119 |
| 3,277,749 | 10/1966 | Osburn et al. | 81/55 |
| 3,651,556 | 3/1972 | Mechan | 81/119 |
| 4,334,443 | 6/1982 | Pearson | 81/55 |

FOREIGN PATENT DOCUMENTS

| | | | |
|---|---|---|---|
| 22578 | of 1893 | United Kingdom | 81/119 |

*Primary Examiner*—James L. Jones, Jr.

*Attorney, Agent, or Firm*—Brooks, Haidt, Haffner & Delahunty

[57] ABSTRACT

A method and a specially adapted tool are disclosed for tightening or loosening the compression nut on the lower end of a vertically disposed riser tee pipe fitting which is mounted on a vertically projecting nipple on an underground gas main, while standing at ground level and using an extension handle connected to the tool. The tool is generally E-shaped, its body portion having a laterally projecting open-end wrench element at its lower end; a laterally projecting gripper plate at its upper end by which the tool is engaged and manipulated by the extension handle; and a laterally projecting stabilizer element therebetween which braces the tool against the upper end of the riser tee while the compression nut is being turned.

4 Claims, 5 Drawing Figures

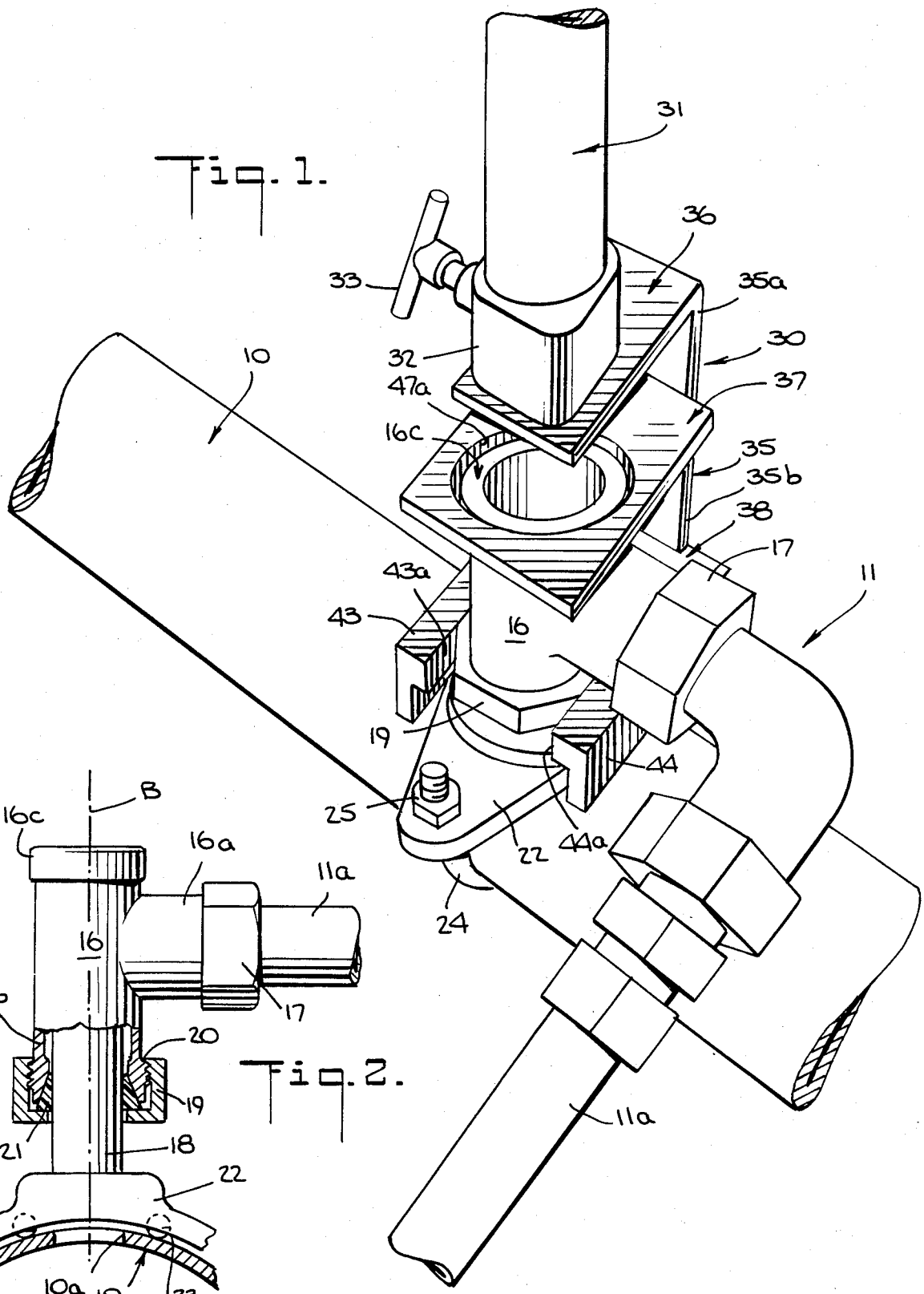
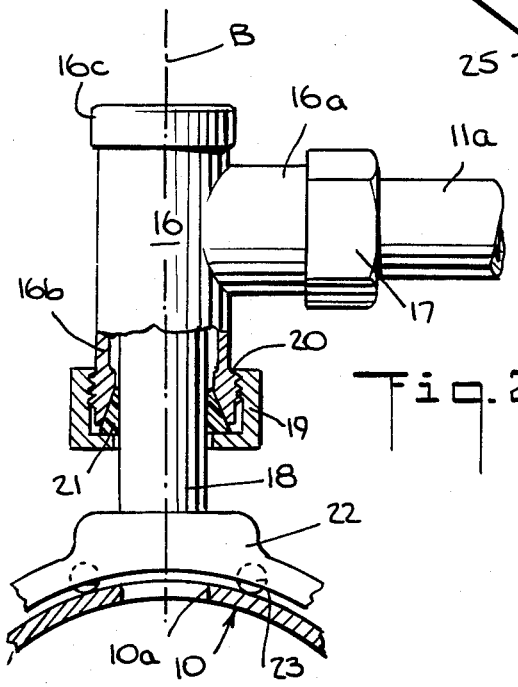
Fig. 2.

Fig.4.
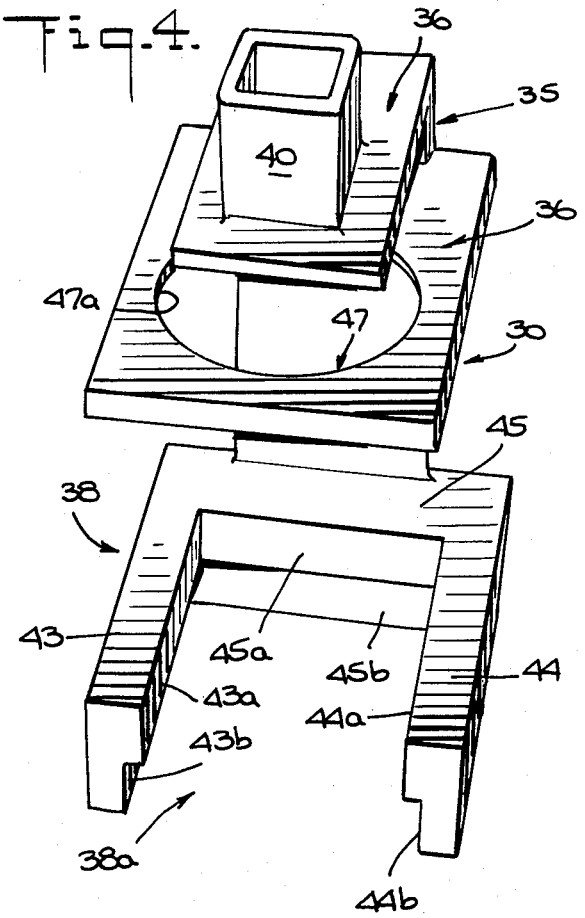
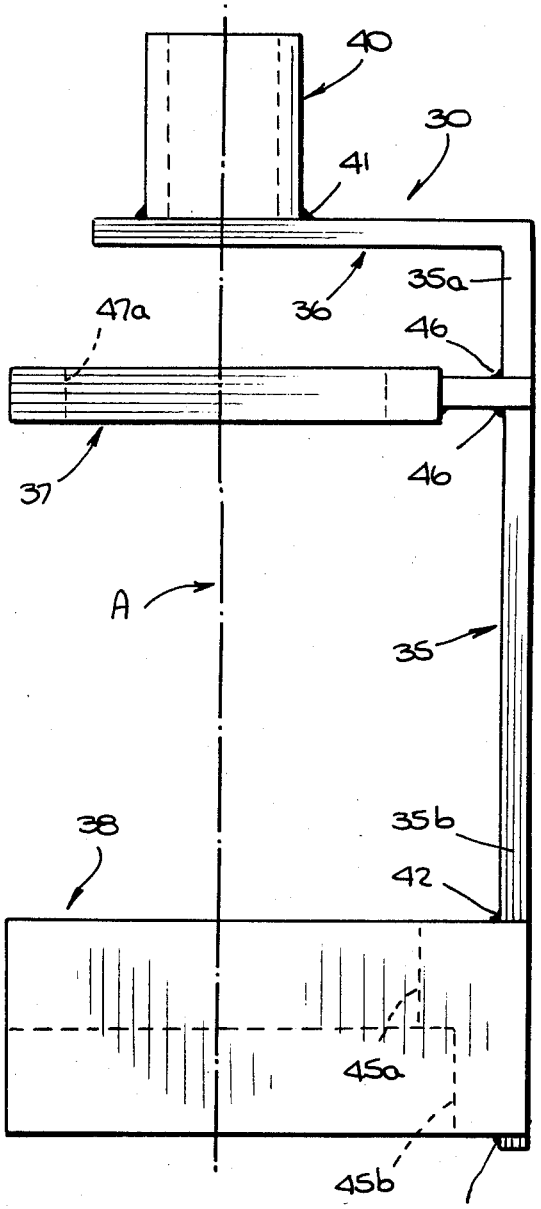
Fig.5.
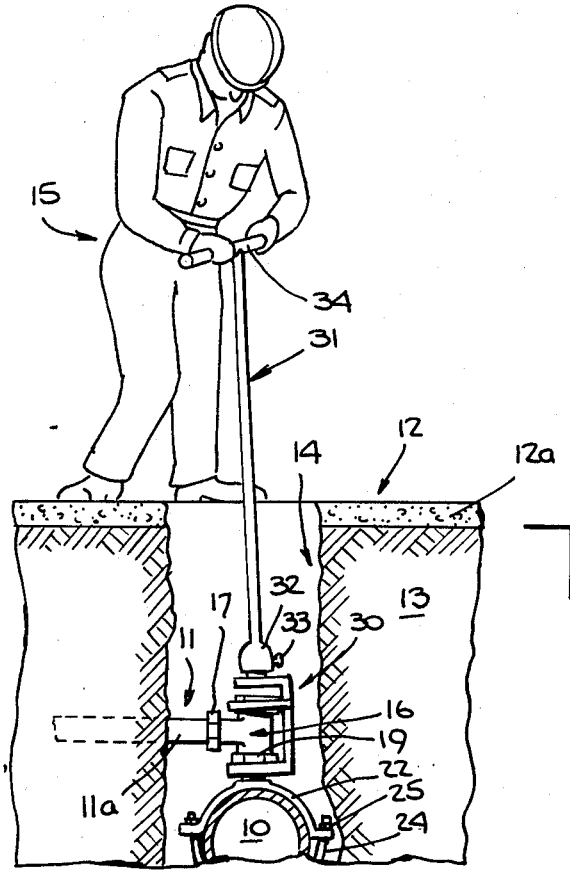
Fig.3.

RISER TEE WRENCH

FIELD OF THE INVENTION

This invention relates to methods and specialized tools for use in repairing gas utility service lines and, more particularly, to wrench type tools used for such purpose.

BACKGROUND AND OBJECTS OF THE INVENTION

A major cost incurred in the repair of underground gas utility supply lines is for excavation and backfill of the street or roadway beneath which a repair is to be made, such as a required removal or replacement of the connection between a gas service line and a gas main. Large size excavations take longer to create and to refill and, when left open overnight or unattended, any street excavation poses a danger to vehicular traffic and to pedestrians. In order to reduce this cost and to eliminate such dangers, vacuum digging techniques have been developed by which relatively deep excavations having fairly small areas of opening can be made to reach the service line connection to the main for the required repair. However, such reduced size excavations, which are smaller than such as will permit a man to work therein, require specially adapted, long-handled tools for making repairs remotely, while standing at ground level, and special techniques for manipulating such tools, which extend down into the excavation.

Many such specially adapted tools have been made, and are currently in use. For example, gas leaks at the bell joint between conjoining cast iron conduits have been repaired remotely from above grade, using elongated tools for forcing packing into the bell joint. But, to date, no remotely manipulatable tool or technique is available for tightening (or loosening) the standard compression nut connection between the common, vertically disposed riser tee and the gas main nipple, by which each gas service line in the usual gas supply system draws gas from the gas supply main.

Accordingly, it is intended by the present invention to provide a tool and a method for working from a standing position, at ground level, within a very narrow excavation, when connecting or removing a riser tee which is mounted on an underground gas main, which procedure is required whenever an underground gas service line is removed or replaced. The tool should be readily controllable from the above-ground location and, of course, must be effective to permit turning of the attachment nut without undue difficulty.

BRIEF DESCRIPTION OF THE INVENTION

Briefly describing the invention in its preferred embodiment, a specially adapted tool is provided for the purpose which has a laterally projecting open-end type wrench at the lower end of its body portion for engaging the riser tee compression nut, and a laterally projecting gripper plate at the upper end of the body portion by which the tool is engaged and manipulated using an attached, elongated handle element. Preferably, a laterally projecting stabilizer plate extends from the body portion to engage and brace the tool against the upper end of the riser tee as the tool is being pivoted or turned to turn the compression nut, which is on the lower end of the tee. This stabilizing engagement is by means of an aperture in the stabilizer plate, through which only the upper end of the riser tee projects when the wrench portion of the tool is in engagement with the nut.

Thus, when tightening or loosening the riser tee compression nut, the stabilizer element of the tool is held against the fixed riser tee itself, during the turning of the tool. The tool is therefore less likely to slip out of engagement with the nut as the sometimes heavy, manual pressures are exerted on the handle extension to turn the tool.

As previously indicated, the gas main and the riser tee connection thereto are normally buried several feet below street level, and the tool of the invention makes possible a much smaller area of excavation, not more than about two feet by two feet, when exposing the connection for repair. That is, the repairman merely attaches the riser tee wrench to a so-called "universal bar" or similar long-handled tool and extends it down into the excavation to engagement with the riser tee nut. The stabilizer plate naturally locates itself around the upper end of the tee as the open-end wrench element engages the nut. The tool is then turned using the universal bar extension until the nut has been tightened to sufficiently expand the peripheral packing, located within the nut, against the nipple which is attached to the gas main.

The tool is then easily disengaged from the riser tee nut.

DETAILED DESCRIPTION OF THE PREFERRED EMBODIMENTS

These and other objects, features and advantages of the invention will be more readily apparent from the following detailed description thereof, when read with reference to the accompanying drawings, in which:

FIG. 1 is a perspective view showing a conventional attachment between a gas service line and a gas main via a riser tee pipe fitting, with a riser tee wrench in accordance with the invention in engagement with the latter;

FIG. 2 is a side elevational showing, to a somewhat reduced scale and partially in section, of a riser tee as it appears when attached to a gas main nipple;

FIG. 3 is a perspective showing of the method of tightening (or loosening) a riser tee compression nut in accordance with the invention;

FIG. 4 is a perspective view of the riser tee wrench provided by the invention; and FIG. 5 is an enlarged, side elevational showing of the wrench.

Referring first to FIGS. 1 and 3, a typical gas utility supply system for supplying natural gas to buildings such as residences, etc., includes a large diameter street gas main, as generally indicated by reference numeral 10, which is tapped at intervals along its length corresponding to the locations of the buildings by the respective service lines which lead the gas from the main into the basement of each building. One such service line is generally indicated by reference numeral 11 and, as illustrated in FIG. 3, it will be understood that the gas supply system including the main 10 and each service line 11 is buried usually three or more feet below street level as generally indicated by reference numeral 12. The locations of attachment of the service lines 11 to the main 10 are normally covered by earth, generally indicated by numeral 13, which in FIG. 3 is shown as having been excavated from around one such connection, the excavation opening 14 being only about 2'×2' in area, down to the depth of the main 10. In any event, it will be noted that the size of the excavation opening 14 is too narrow to permit a repairman, generally indicated by numeral 15, to climb down into the excavation to repair the connection between the service line 11 and the gas main 10.

The connection between the service line 11 and the gas main 10 is via a riser tee pipe fitting, generally indicated by numeral 16, to the branch 16*a* of which the service line piping 11*a* is connected by means of a branch compression nut 17. The lower end 16*b* of the vertically disposed riser tee pipe fitting 16, connects with the gas main 10 via an upwardly projecting pipe nipple 18 to which the riser tee lower end is attached by a lower end compression nut 19, which is threaded onto the body of the riser tee on threads 20. The gas-tight connection between the nipple 18 and the riser tee 16 is effected by a compressible packing 21 which is expanded into tight fitting pressure engagement against the periphery of the nipple 18 upon tightening the nut 19 on the lower end 16*b* of the riser tee 16, as is well known. As will be understood from FIG. 2, the lower end of the nipple 18 is threadedly attached by threads (not shown), and extends through the upper end of a saddle 22 which is tightened onto the the gas main 10. The saddle 22 carries a circular O-ring 23 which, upon tightening of the saddle 22 on the main 10, is compressed in surrounding relation to the gas aperture 10*a* of the main, by which natural gas flows from the main into the nipple 18 and thence into the service line 11 via the riser tee 16, all in well-known manner. As seen in FIG. 1, the saddle 22 is attached and tightened about the gas main 10 by means of a U-bolt 24 which extends around the underside of the main 10, as a strap, and is bolted and tightened on the saddle 22 by the bolts 25 at either end of the saddle 22.

The present invention involves so-called "small hole" techniques for cutting and capping of a low pressure gas service wherever a riser tee is to be removed, or for renewing a service which has a riser tee connection, as would be necessary if a leak were detected along the service line. A usual technique when renewing such a service is to reline the existing service line by inserting a smaller diameter plastic tubing within the line between the building and the main, which interior by-pass tubing then becomes, in effect, the service line itself. In any event, it is necessary to reconnect the service line to the main, which requires attachment of a new riser tee pipe fitting to the end of the service line by-pass tubing, and subsequent connection of the riser tee to the existing, or a newly installed take-off nipple on the main.

Referring to FIG. 3, when making such replacements a 2′×2′ hole is broken through the hardened top surface 12*a* of the street, and the soil 13 is loosened using a clay spade, or digging bar or the like. Vacuum digging equipment is then used to remove the loosened soil. After the service line connection which is to be removed or replaced is exposed, it is cleaned in a conventional manner using a pneumatic scaler to remove large scale and soil, and is then grit blasted.

In the typical procedure after the connection is exposed, the so-called completion plug (not shown) which is normally threaded into the upper end 16*c* (FIG. 2) of the riser tee 16 is removed, and a temporary stopper is forced into the nipple below the tee to stop the flow of gas. The service line piping is then cut adjacent the service tee, and again near the edge of the excavation 14. The service tee 16 is then removed by loosening its lower compression nut 19 which attaches it to the riser nipple or pipe 18. After the tee has been removed, the saddle bolt nuts 25 (FIGS. 1 and 3) are loosened and the saddle 22 and U-bolt 24 are slid aside on the main 10, whereupon the exposed tap hole 10*a* is covered with duct seal to temporarily stop the flow of gas therethrough, while the new fittings are being installed. The old saddle and U-bolt are then removed, and the previously described scaling and grit blasting procedures are used to clean the main where the new saddle and U-bolt is to be positioned on the tap hole 10*a*. After cleaning, the duct seal is removed and the new saddle, with a riser nipple 18 attached thereto, is then placed on the main 10 and attached using the U-bolt 24 by tightening the U-bolt nuts 25, the nipple 18 being temporarily plugged at this time. If the service is to be by-passed as previously mentioned, the service line interior by-pass tubing, with a new riser tee attached as previously described, is then pushed through the exposed cut-end of the old service line where it emerges from the soil 13 within the excavation 14, and the new riser tee must be attached to the upwardly projecting riser nipple 18 of the new saddle 22 on the main 10.

The present invention provides a method and apparatus for both loosening and tightening the adjustment nut 19 when an old riser tee, or a new riser tee is to be either disconnected or attached to a riser nipple 18. As will be understood particularly from FIG. 3, the attachment nut 19 which is to be turned is at the underside of the upwardly projecting riser tee 16 as it appears within the excavation hole on the riser nipple 18. Prior to the present invention, it was very difficult and inefficient for a repairman to attempt to reach down into the excavation 14 to apply a wrench to the nut 19 to either tighten it or loosen it, as will be readily apparent. The present invention provides a riser tee wrench, generally indicated by reference numeral 30, for connection to a conventional univeral bar 31 (FIGS. 1 and 3) which serves as an elongated handle on the tool, for use by a repairman 15 who stands at ground level 12 when loosening or tightening the nut 19. As will be subsequently described, the tool 30 is adapted for use with either of two sizes of riser tees, such as either a 1½″ or a 2″ riser tee. The manner in which the tool is used will be better understood following the description of its features.

Referring now to FIGS. 4 and 5, a riser tee wrench 30 in accordance with the invention is constructed from any conventional low-carbon steel plate which may be easily cut and welded. The tool 30 may be characterized as generally E-shaped, being formed by a body portion 35 from which a gripper plate 36, a stabilizer plate 37, and an open-end wrench element 38 project laterally in the same direction, in spaced apart relation along the length of the body portion 35, as seen particularly in FIG. 5.

The gripper plate 36 projects laterally from the upper end 35*a* of the body portion, and may be welded thereto, or formed by bending an upper portion of the plate which forms the body portion 35 itself, as shown in FIG. 5. In any event, the gripper plate 36 carries a projecting nut-like element 40, which is welded thereto as at 41, by which the tool is engaged by and connected to the universal bar 31. That is, the nut-like element 40 is formed by plate steel, which is bent or welded to a square shape, as shown, to be received in the correspondingly square-shaped socket opening of the socket portion 32, attached on the lower end of the universal bar 31. Such square-shaped socket 32 is conventional on many so-called "universal bars". The connection is secured by a thumb screw 33 which extends through a threaded side opening in the socket portion 32 to engage and tighten against the portion 40 of the tool 30, when the two are attached. Briefly referring to FIG. 3, the connected wrench 30 and universal bar 31 will be manipulated using the handle 34 on the upper end of the universal bar 31.

However, it should be noted that the nut-like projection 40 is located on the gripper plate 36 such that its longitudinal axis, indicated by letter "A" in FIG. 5, coincides with the axis "B" (FIG. 2) of the main body of the riser tee 16 when the tool engages the nut 19 of the riser tee, as illustrated in FIG. 1.

At the lower end 35*b* of the body portion 35, the tool 30 has a laterally projecting open-end wrench portion 38 which is attached thereto, as by welding 42. The wrench portion 38 is substantially U-shaped, being formed by a pair of spaced-apart, laterally projecting parallel arm portions 43 and 44 (FIG. 4), and a connecting portion 45 which forms the bottom of the U-shape. The lateral spacing between the co-facing vertical surfaces 43*a*, 44*a* on the respective arms 43, 44 is equal to the minor dimension across the octagonal nut 19, to engage the same for turning, as illustrated in FIG. 1. The depth of the U-shaped wrench portion 38 from its open end 38*a* to the forwardly facing vertical surface 45*a* at the bottom of the U-shape is substantially the same, but in any event is sufficient to accommodate the nut 19, as will be understood. Thus, the middle length locations along the surfaces 43*a*, 44*a* are approximately in line with axis "A" of the nut projection 40 (FIG. 5), and it will be understood that the turning forces applied at the projection 40 are thus more easily and uniformly applied by the arm surfaces 43*a*, 44*a* to the riser tee compression nut 19 when the tool is in engagement therewith.

Referring particularly to FIG. 4, it will be seen that each of the arms 43, 44 and 45 of the wrench portion 38 is grooved extending along the lower portion of its height to provide wider, spaced-apart cofacing vertical surfaces 43*b* and 44*b* which respectively extend along the lengths of the arms 43 and 44. The arm 45 is similarly grooved at 45*b*. In this manner, the same tool 30 is adapted for use in tightening or loosening the compression nut on a 2" riser tee, as well as that of a smaller, 1½" riser tee. Because these widened surfaces extend along the lower peripheries of the arms 43, 44 and 45, it will be understood that the tool automatically accommodates the higher vertical dimension of the larger, 2" riser tee. In this regard, it should also be noted that the spacing distance along the axis "A" (FIG. 5) between the open-end wrench portion 38 and the gripper plate 36 of the tool 30, is larger than the vertical height of any riser tee pipe fitting which the tool is intended to accommodate.

Referring now to the stabilizer plate 37 which is attached, as by welding 46, to the body portion 35, it has a circular opening 47 (FIG. 4) therein, which is also centered on the axis "A" (FIG. 5). The opening 47 provides a vertical surface 47*a* for engaging the circular flange at the upper end 16*c* of the riser tee 16 when the tool 30 engages the tee, as illustrated in FIG. 1. Thus, it will be understood that the location of the stabilizer plate 37 along the length of the body portion 35 is such that its interior surface 47*a* will engage the upper end 16*c* of the riser tee when its nut 19 is engaged by the wrench portion 38, i.e., the spacing distance between the plate 37 and the wrench portion 38 is less than the height of the riser tee 16 by an amount approximately equal to sum of the heights of the nut 19 and the flange at the upper end 16*c* of the tee. In this regard, it should be noted that the height of the riser tee 16 with its nut 19 thereon will become shorter as the nut 19 is tightened upwardly on the tee 16, and that the dimension between the plate 37 and the wrench portion 38 should be determined accordingly. In addition, the diameter of the opening 47 must be larger than that of the flange at the upper end 16*c* of the riser tee 16. Further, it has been found that, by making the diameter of the aperture 47 slightly larger than the diameter of a conventional 2" riser tee, and considering that the wrench portion 38 includes the widened, nut engaging surfaces 43*b*, 44*b*, the same tool 30 will accommodate a 2" riser tee as well as a 1½" sized tee.

Turning now to a description of the manner of use of the tool 30, when the attachment or compression nut 19 is to be loosened to disconnect a riser tee 16 from a riser nipple 18 on a gas main 10, or is to be tightened thereon, the tool 30 is connected to the socket end of the universal bar 31 as previously described, and is extended down into the excavation 14 to the location of the riser tee, as seen in FIG. 3. The repairman 15 stands at grade level 12 and manipulates the tool using the handle 34 of the universal bar 31, as will now be described.

With reference to FIGS. 1 and 3, the tool is moved downwardly and then inwardly towards the center of the riser tee so that its wrench portion 38 engages the nut 19 at the underside of the tee while the interior vertical surface 47*a* of the stabilizer plate 37 is placed in engagement with the flange at the upper end 16*c* of the tee. As will be understood, engagement of the surface 47*a* with the top of the fixed body of the tee 16 when the wrench portion 38 is in engagement with the nut 19 will brace or steady the tool as it is turned by the repairman in one direction or the other to either tighten or loosen the nut 19. The tool may be turned as much as about three-quarters of a revolution before it must be disengaged and returned to again engage the nut 19 to tighten or loosen it further, as will be understood.

When the work has been completed, the comparatively small-sized excavation hole 14 is easily back-filled and tamped, whereupon the street opening is patched to complete the repair.

Thus has been described a method for turning the compression nut on the underside of a riser tee, while working from street level, to tighten or loosen the tee in its position on a gas main which is located several feet below street level, and within a relatively small-sized excavation opening, and a riser tee wrench which may be used in practicing such method, which achieve all of the objects of the invention.

What is claimed is:

1. For disconnecting and connecting a riser service tee wherein the riser service tee has an upper end, and a lower end spaced a distance from, and aligned with said upper end along a vertical axis of said riser tee, said riser tee lower end having a threaded compression nut rotatably mounted thereon, a tool having a longitudinal axis for alignment with said riser tee axis, and comprising a tool body portion extending parallel to, but displaced laterally from said longitudinal axis of the tool and having respective upper and lower ends, a substantially U-shaped open-end wrench portion of said tool attached at the base of said U-shape to said lower end of said tool body portion and having parallel, spaced apart arm portions corresponding to the respective legs of said U-shape and which project laterally towards and beyond said longitudinal axis of the tool, said arm portions having respective middle length locations on respectively opposite sides of said longitudinal axis of the tool for engaging said riser tee compression nut to turn the same, a laterally projecting tool gripper plate on said upper end of said tool body portion, said tool gripper plate projecting in substantially the same lateral direction as said arm portions of said tool wrench portion and having gripper means projecting thereon and aligned on said longitudinal axis of the tool for grasping and turning said tool to correspondingly turn its said wrench portion, the longitudinal spacing distance between said tool wrench portion and said tool gripper plate being greater than said distance between said upper and lower ends of said riser tee, a laterally projecting tool stabilizer plate on said tool body portion at a location between its said upper and lower ends and projecting in substantially the same lateral direction as said tool wrench portion and said tool gripper plate, said tool stabilizer plate being longitudinally spaced away from said tool wrench portion a distance which is less than said distance between said upper and lower ends of said riser tee and having means defining a circular aperture aligned on said tool axis and being larger than said riser tee upper end to receive the latter therein and providing a peripherally extending engagement surface for engaging said upper end of said riser tee when said tool wrench portion arm portions enqaqe said riser tee compression nut to turn the same.

2. A tool according to claim 1, wherein each said tool wrench portion arm portion has a laterally grooved inner wall surface to define pairs of cofacing respective upper surface portions and lower surface portions, the spacing distance between said pair of cofacing upper surface portions being less than that between said pair of cofacing lower surface portions.

3. A tool according to claim 1, wherein said tool gripper means comprises means defining a nut-like projection disposed on said longitudinal axis of said tool and projecting in the direction of said upper end of said body portion, said nut-like projection being adapted for engagement by a socket wrench.

4. A tool according to claim 3, which further comprises an elongated extension handle for turning said tool from a remote location, said extension handle having opposite ends, handle means on one of its said ends for manually grasping and manipulating said extension handle, a socket wrench on the other side of its said ends and engaging said nut-like projection on said tool, and releasable means securing said socket wrench and said nut-like projection in their said engagement.

* * * * *